US010969151B2

(12) United States Patent
Tanimura

(10) Patent No.: US 10,969,151 B2
(45) Date of Patent: Apr. 6, 2021

(54) ICE MAKING DEVICE AND METHOD OF INSPECTING THE SAME

(71) Applicant: NIDEC SANKYO CORPORATION, Nagano (JP)

(72) Inventor: Satoshi Tanimura, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 85 days.

(21) Appl. No.: 16/116,940

(22) Filed: Aug. 30, 2018

(65) Prior Publication Data

US 2019/0063811 A1 Feb. 28, 2019

(30) Foreign Application Priority Data

Aug. 31, 2017 (JP) ..... JP2017-166791

(51) Int. Cl.
*F25C 1/10* (2006.01)
*F25C 1/22* (2018.01)
(Continued)

(52) U.S. Cl.
CPC ..... *F25C 1/10* (2013.01); *F25C 1/04* (2013.01); *F25C 1/22* (2013.01); *F25C 1/24* (2013.01);
(Continued)

(58) Field of Classification Search
CPC ..... F25C 2700/12; F25C 2600/04; F25C 2305/022; F25C 1/10; F25D 29/00
See application file for complete search history.

(56) References Cited

U.S. PATENT DOCUMENTS 4,426,851 A * 1/1984 Neumann ..... F25C 1/147 340/514
4,741,169 A * 5/1988 Linstromberg ..... F25C 5/08 62/135
(Continued)

FOREIGN PATENT DOCUMENTS

CN 101158527 4/2008
CN 201251331 6/2009
(Continued)

OTHER PUBLICATIONS

"Office Action of China Counterpart Application", dated Apr. 3, 2020, with English translation, p. 1-p. 12.
(Continued)

*Primary Examiner* — Kun Kai Ma
(74) *Attorney, Agent, or Firm* — JCIPRNET

(57) ABSTRACT

Provided are an ice making device and a method of inspecting the same. In the ice making device, signal lines extending from a temperature sensor are connected to a drive unit. The drive unit performs an ice removal process of removing ice from an ice making tray when a temperature detected by the temperature sensor is equal to or lower than a set temperature. The drive unit performs a sensor inspection process of automatically inspecting whether the temperature sensor is abnormal based on an inspection execution command issued by an operation of a test switch during general processes including supplying water to the ice making tray and an ice making process. Thus, inspection of a drive mechanism of the drive unit and inspection of the temperature sensor can be performed in a series of operations.

14 Claims, 6 Drawing Sheets

(51) Int. Cl.
*F25C 1/04* (2018.01)
*F25C 1/24* (2018.01)
*F25C 5/06* (2006.01)

(52) U.S. Cl.
CPC ..... *F25C 5/06* (2013.01); *F25C 2305/022* (2013.01); *F25C 2600/04* (2013.01); *F25C 2700/12* (2013.01); *F25C 2700/14* (2013.01)

(56) References Cited

U.S. PATENT DOCUMENTS

2007/0227164 A1* 10/2007 Ito ..... F25C 5/06 62/135
2010/0218524 A1* 9/2010 Saito ..... F25D 23/12 62/135
2015/0068224 A1* 3/2015 Subera ..... F25C 5/187 62/66
2016/0116199 A1* 4/2016 Fischer ..... F25C 5/185 62/344
2016/0298893 A1* 10/2016 Knatt ..... F25C 1/12
2017/0167994 A1* 6/2017 Okamoto ..... G01N 27/4075

FOREIGN PATENT DOCUMENTS

CN 101818976 9/2010
CN 105157297 12/2015
JP H05157421 6/1993
JP 05332651 A * 12/1993
JP 2002181421 6/2002

OTHER PUBLICATIONS

"Office Action of China Counterpart Application", dated Nov. 18, 2020, with English translation thereof, pp. 1-12.

* cited by examiner

ICE MAKING DEVICE AND METHOD OF INSPECTING THE SAME

CROSS-REFERENCE TO RELATED APPLICATION

This application claims the priority benefit of Japan application serial no. 2017-166791, filed on Aug. 31, 2017. The entirety of the above-mentioned patent application is hereby incorporated by reference herein and made a part of this specification.

BACKGROUND

Technical Field

The disclosure relates to an ice making device configured to perform an ice removal process based on a monitoring result by a temperature sensor and a method of inspecting the same.

Related Art

An ice making device mounted in a refrigerator includes an ice making tray in which recessed parts for water storage are disposed upward; a temperature sensor such as a thermistor fixed to a bottom surface of the ice making tray, and a drive unit. The drive unit performs an ice removal operation of removing ice from the ice making tray, for example, when a temperature detected by the temperature sensor is equal to or lower than a set temperature (refer to Japanese Laid-open No. 2002-181421). Even before the ice making device is mounted in a refrigerator main body, when the drive unit is operated, inspection of the drive unit can be performed.

When a control unit for a drive unit within an ice making device is provided in a refrigerator main body, and is not provided in the ice making device, a signal line that extends from a temperature sensor such as a thermistor is connected to the control unit provided in the refrigerator main body (outside of the ice making device) through a connector or the like. Thus, inspection of the temperature sensor can be performed by the control unit provided outside the ice making device through the connector. However, when the drive unit itself monitors a temperature detected by the temperature sensor, since the signal line of the temperature sensor is not drawn to the outside, there is a problem that inspection of the temperature sensor can't be performed until the ice making device is attached to the refrigerator.

SUMMARY

An ice making device according to the disclosure includes an ice making tray in which recessed parts for water storage are disposed upward; a temperature sensor that is fixed to a bottom surface of the ice making tray; and a drive unit to which a signal line that extends from the temperature sensor is connected and which performs an ice removal operation of removing ice from the ice making tray when a temperature detected by the temperature sensor is equal to or lower than a set temperature, wherein the drive unit includes a sensor inspection unit that performs a sensor inspection process of automatically inspecting whether the temperature sensor has an abnormality based on an inspection execution command.

A method of inspecting an ice making device according to the disclosure including an ice making tray in which recessed parts for water storage are disposed upward, a temperature sensor that is fixed to a bottom surface of the ice making tray; and a drive unit to which a signal line that extends from the temperature sensor is connected and which performs an ice removal operation of removing ice from the ice making tray when a temperature detected by the temperature sensor is equal to or lower than a set temperature is provided, the method including performing, by the drive unit, a sensor inspection process of automatically inspecting whether the temperature sensor has an abnormality based on an inspection execution command.

DESCRIPTION OF THE EMBODIMENTS

Figure 1:
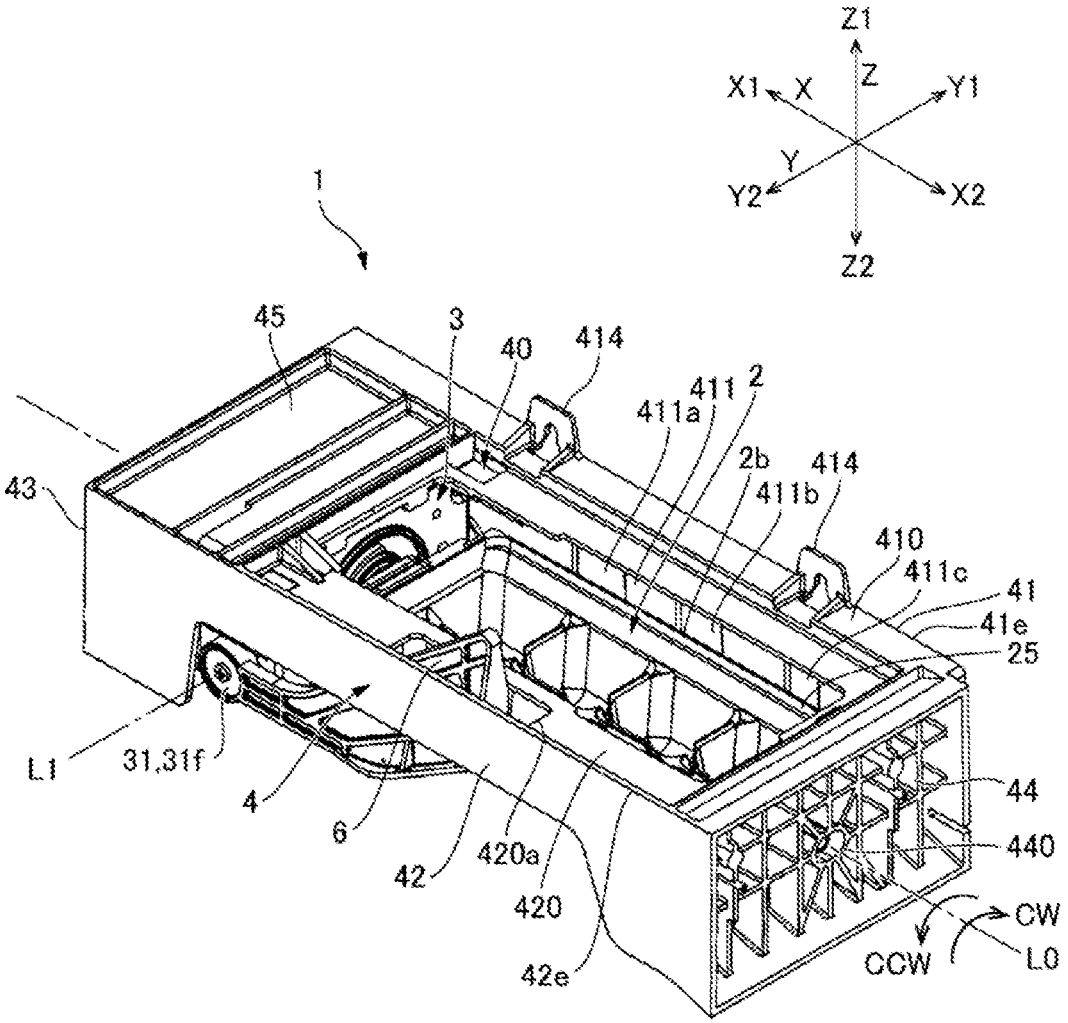
FIG. 1 is a perspective view of an ice making device to which the disclosure is applied when viewed from the side on which a second side plate is positioned and viewed obliquely from above.

The disclosure provides an ice making device in which inspection of a temperature sensor can be performed when a signal line that extends from the temperature sensor is connected to a drive unit and a method of inspecting the same.

In the disclosure, since the signal line that extends from the temperature sensor is connected to the drive unit, when the ice making device is mounted in the refrigerator main body, the ice making device is easily mounted in the refrigerator main body, for example, because it is not necessary to connect the signal line to the refrigerator main body. In this case, because the temperature sensor is not connected to the outside (refrigerator main body) of the ice making device through a connector or the like, it is not possible to perform inspection of the temperature sensor through the connector. However, in the disclosure, using the connection of the signal line that extends from the temperature sensor to the drive unit, the drive unit itself automatically performs inspection of the temperature sensor. Accordingly, even if the signal line that extends from the temperature sensor is connected to the drive unit, inspection of the temperature sensor can be performed.

In the ice making device according to the disclosure, an aspect in which the drive unit includes a drive mechanism configured to perform an ice removal operation and a control unit configured to monitor a detection result by the temperature sensor and cause the drive mechanism to perform the ice removal operation when a temperature of the ice making tray is equal to or lower than a set temperature, and the sensor inspection unit is provided in the control unit can be used. In the method of inspecting an ice making device according to the disclosure, an aspect in which, in the drive unit, a drive mechanism configured to perform an ice removal operation and a control unit configured to monitor a detection result by the temperature sensor and cause the drive mechanism to perform the ice removal operation when the temperature of the ice making tray is equal to or lower than a set temperature are provided, and the control unit performs the sensor inspection process based on the inspection execution command can be used. According to this aspect, inspection of the temperature sensor can be performed using a microcomputer used for the control unit or the like.

In the disclosure, an aspect in which the drive unit performs the sensor inspection process during general processes including a process of supplying water to the ice making tray and an ice making process in the ice making tray can be used.

In the disclosure, an aspect in which the drive unit includes a test switch, and the inspection execution command is issued when an operation for performing the sensor inspection process is performed on the test switch can be used.

In the disclosure, an aspect in which the drive unit includes an AC-DC converter configured to convert an AC voltage supplied from the outside into a DC voltage, and the ice removal process and the sensor inspection process are automatically performed using the DC voltage supplied from the AC-DC converter can be used. In such a configuration, various processes can be performed in the drive unit even if there is no DC voltage supplied from the outside. In the disclosure, an aspect in which the drive unit issues a water supply command to a water supply device that supplies water to the ice making tray can be used. According to this aspect, it is suitable to perform the sensor inspection process during general processes including the water supply process and the like.

In the disclosure, an aspect in which the temperature sensor is a thermistor can be used.

In the disclosure, since the signal line that extends from the temperature sensor is connected to the drive unit, when the ice making device is mounted in the refrigerator main body, the ice making device is easily mounted in the refrigerator main body, for example, because it is not necessary to connect the signal line to the refrigerator main body. In this case, because the temperature sensor is not connected to the outside (refrigerator main body) of the ice making device through a connector or the like, it is not possible to perform inspection of the temperature sensor through the connector. However, in the disclosure, using the connection of the signal line that extends from the temperature sensor to the drive unit, the drive unit itself automatically performs inspection of the temperature sensor. Accordingly, even if the signal line that extends from the temperature sensor is connected to the drive unit, inspection of the temperature sensor can be performed.

Embodiments of the disclosure will be described with reference to the drawings. In the following description, three directions that cross each other will be described as a first direction X (length direction), a second direction Y (width direction), and a third direction Z (vertical direction). In addition, in the description, X1 refers to one side in the first direction X, X2 refers to the other side in the first direction X, Y1 refers to one side in the second direction Y, Y2 refers to the other side in the second direction Y, Z1 refers to one side (upper side) in the third direction Z (vertical direction), and Z2 refers to the other side (lower side) in the third direction Z (vertical direction).

Overall Configuration

Figure 2:
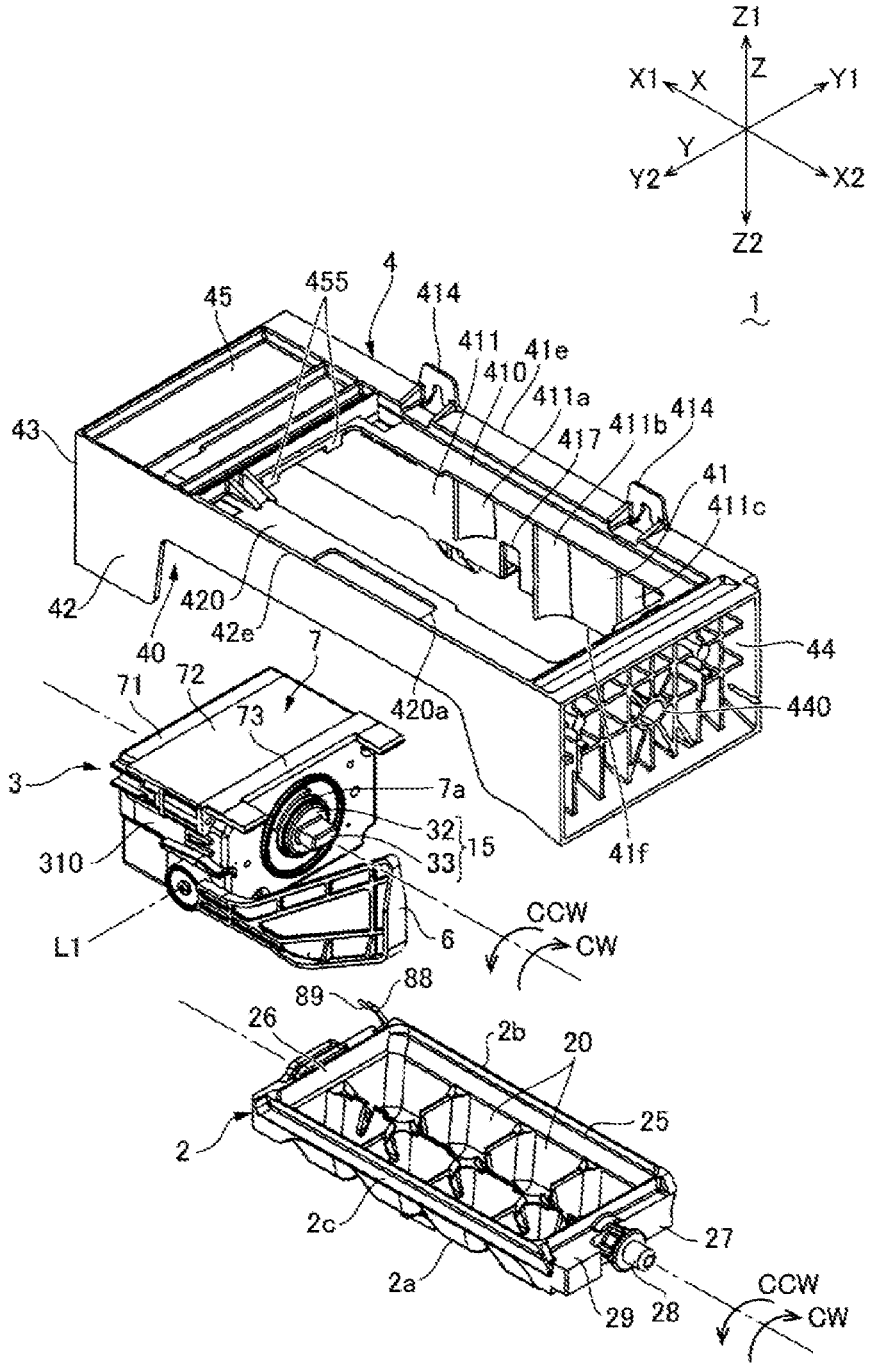
FIG. 2 is an exploded perspective view of the ice making device shown in FIG. 1 when viewed from the side on which the second side plate is positioned and viewed obliquely from above.
Figure 3:
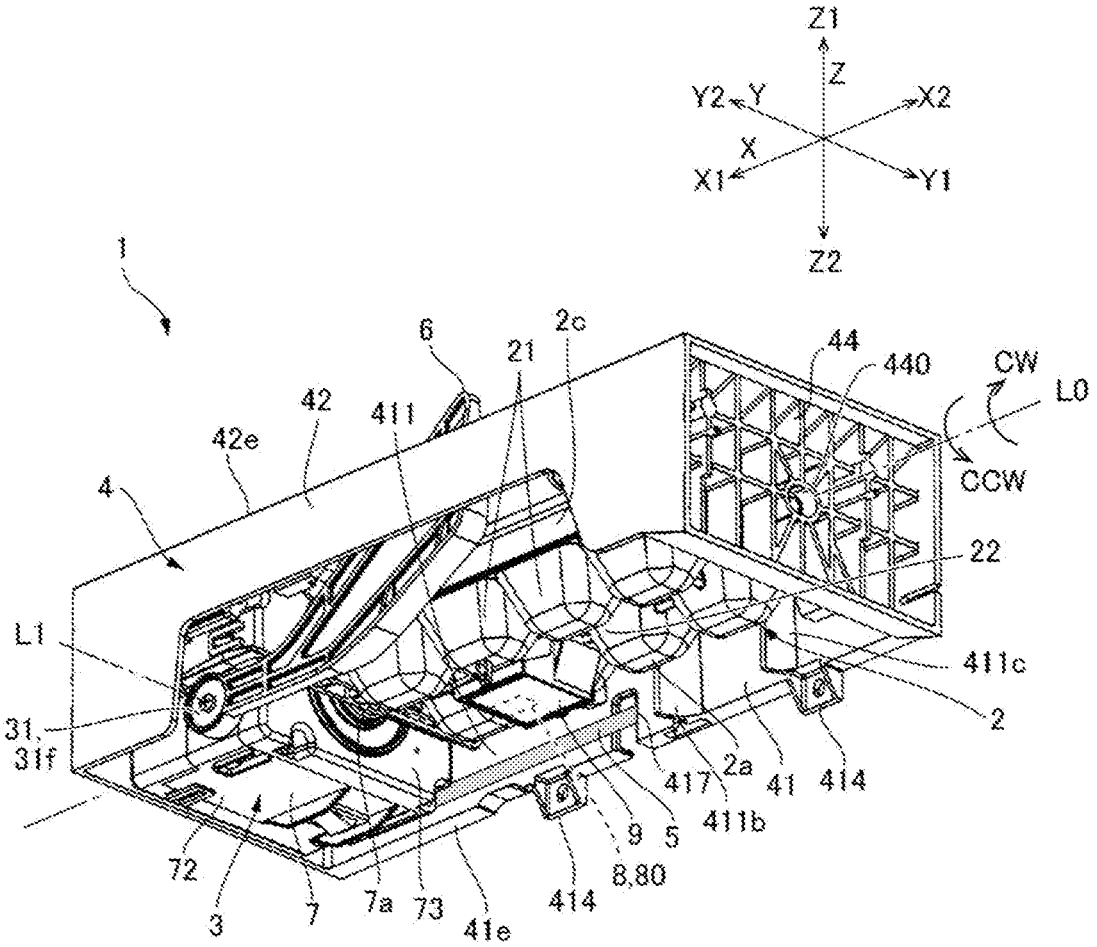
FIG. 3 is a perspective view of the ice making device shown in FIG. 1 when viewed from the side on which a second side plate is positioned and viewed obliquely from below.

FIG. 1 is a perspective view of an ice making device 1 to which the disclosure is applied when viewed from the side on which a second side plate 42 is positioned and viewed obliquely from above. FIG. 2 is an exploded perspective view of the ice making device 1 shown in FIG. 1 when viewed from the side on which the second side plate 42 is positioned and viewed obliquely from above. FIG. 3 is a perspective view of the ice making device 1 shown in FIG. 1 when viewed from the side on which the second side plate 42 is positioned and viewed obliquely from below.

The ice making device 1 shown in FIG. 1 to FIG. 3 includes an ice making tray 2 in which recessed parts for water storage 20 (cells) are dispose toward the one side Z1 (upper side) in the third direction Z, a drive unit 3 that is disposed on the one side X1 of the ice making tray 2 in the first direction X, and a frame 4 including a mounting unit 40 on which the drive unit 3 is mounted. The ice making device 1 is mounted in a refrigerator main body (not shown). In the refrigerator, water in a water supply tank (not shown) is filled into the recessed parts for water storage 20 of the ice making tray 2 through a water supply pipe (not shown) in a water supply process and ice making is performed in an ice making process. Then, when the ice making is completed, the drive unit 3 causes the ice making tray 2 to perform an inversion operation around an axis L0 (first axis) that extends in the first direction X and a twist operation that is in connection with the inversion operation in an ice removal process, and thereby causes ice in the ice making tray 2 to fall into a lower ice storage container (not shown).

Configuration of Ice Making Tray 2

The ice making tray 2 is a member that is made of a resin material and molded to have a substantially rectangular planar shape, and is made of an elastically deformable material. In the ice making tray 2, the plurality of recessed parts for water storage 20 are arranged in the first direction X and the second direction Y. For example, in the ice making tray 2, inside a frame part 25 having a substantially rectangular shape, two recessed parts for water storage 20 arranged in the second direction Y as a set are disposed in four rows in the first direction X. In the frame part 25 of the ice making tray 2, a connecting part (not shown) connected to an output shaft 33 of the drive unit 3 on the axis L0 is formed on a wall part 26 that is positioned on the one side X1 in the first direction X, and a shaft part 28 that is rotatably supported on the frame 4 on the axis L0 is formed on a wall part 27 that is positioned on the other side X2 in the first direction X. On the wall part 27 of the ice making tray 2, a rotation regulating part 29 that comes in contact with the frame 4 when the ice making tray 2 rotates around the axis L0 is formed. The rotation regulating part 29 causes the ice making tray 2 to perform a twist operation by preventing rotation of the ice making tray 2.

In the ice making tray 2, on a bottom surface 2*a* that is positioned on the other side Z2 in the third direction Z, a plurality of convex parts 21 reflecting the shape of the plurality of recessed parts for water storage 20 are arranged. On the bottom surface 2*a* of the ice making tray 2, a temperature sensor 8 configured to detect a temperature of the ice making tray 2 is fixed. Accordingly, determination of whether ice making is completed in the ice making tray 2 can be determined whether a temperature (temperature of the ice making tray 2) detected by the temperature sensor 8 is equal to or lower than a predetermined temperature. The temperature sensor 8 is covered with a cover member 9 fixed to the bottom surface 2*a* of the ice making tray 2 and direct contact of cold air in the temperature sensor 8 is prevented.

Here, signal lines 88 and 89 that extend from the temperature sensor 8 are connected to the drive unit 3. In the present embodiment, the temperature sensor 8 is a thermistor 80.

Configuration of Frame 4 and the Like

The frame 4 includes a first side plate 41 that extends in the first direction X along a first side surface 2*b* of the ice making tray 2 on one side Y1 in the second direction Y, and the second side plate 42 that extends in the first direction X along a second side surface 2*c* of the ice making tray 2 on the other side Y2 in the second direction Y. The first side plate 41 and the second side plate 42 face each other in parallel in the second direction Y. An ice detection lever 6 whose base end side is connected to the drive unit 3 is disposed between the second side plate 42 and the ice making tray 2.

From an upper end 41*e* (edge on the one side Z1 in the third direction Z) of the first side plate 41, a first upper plate part 410 projects toward the second side plate 42. The first upper plate part 410 is bent downward at an intermediate position toward one side Y1 in the second direction Y and then projects toward the second side plate 42. From the vicinity of an upper end 42*e* (edge on the one side Z1 in the third direction Z) of the second side plate 42, a second upper plate part 420 projects toward the first side plate 41. The ice making tray 2 faces upward in an open state (the one side Z1 in the third direction Z) between the first upper plate part 410 and the second upper plate part 420. An opening 420*a* is formed in the second upper plate part 420. The upper end part of the ice detection lever 6 is positioned inside the opening 420*a*.

Ends of the first side plate 41 and the second side plate 42 on the one side X1 in the first direction X overlap the drive unit 3 when viewed in the second direction Y. The first side plate 41 and the second side plate 42 are connected by a plate-like first wall part 43 that is positioned at an end on the one side X1 in the first direction X and a second wall part 44 that is positioned at an end on the other side X2 in the first direction X. The first side plate 41 and the second side plate 42 are also connected by an upper plate part 45 that covers the drive unit 3 from the upper side on the other side Y2 in the second direction Y. Accordingly, in the present embodiment, in the frame 4, a space surrounded by the first side plate 41, the second side plate 42, the first wall part 43, and the upper plate part 45 forms the mounting unit 40 of the drive unit 3. A lower part (the other side Z2 in the third direction Z) of the mounting unit 40 is in an open state. The second wall part 44 is a porous wall in which a plurality of plate-like ribs are connected to each other, and a shaft hole 440 that rotatably supports the shaft part 28 of the ice making tray 2 is formed at the center thereof.

On a wall (an inner wall 411) on the side on which the ice making tray 2 is positioned in the first side plate 41, a plurality of reinforcing ribs 411*a*, 411*b*, and 411*c* are formed to extend in the vertical direction. In the first side plate 41, on a wall (outer wall) on the side opposite to the ice making tray 2, in the upper end 41*e* and a lower end 41*f* of the first side plate 41, on the other side X1 of the drive unit 3 in the first direction, a plurality of attachment parts 414 that fix the frame 4 to a refrigerator main body when the ice making device 1 is mounted in the refrigerator main body (not shown) are formed. In the lower end 41*f* of the first side plate 41, a notch 417 is formed between the attachment parts 414 adjacent to each other in the first direction X. A wiring 5 through which power is supplied to the drive unit 3 extends from the drive unit 3 to the other side X2 in the first direction X along the inner wall 411 of the first side plate 41 and is then drawn to the outside from the notch 417.

Accordingly, when the drive unit 3 causes the ice making tray 2 to perform a twist operation in order to perform an ice removal operation, even if a large force is applied to the frame 4 due to a reaction force, transmission of the force to the side of the notch 417 of the first side plate 41 is prevented by the attachment part 414 fixed to the refrigerator main body provided on the one side X1 of the notch 417 in the first direction X. Therefore, in the first side plate 41, since concentration of stress in the vicinity of the notch 417 can be prevented, it is possible to prevent the first side plate 41 from being damaged in the vicinity of the notch 417.

Configuration of Drive Unit 3

In FIG. 2, a drive mechanism 15 configured to output rotation from the output shaft 33 is disposed in the drive unit 3 inside a case 7 molded in a rectangular parallelepiped shape. In the drive mechanism 15, a rotation force of the driving source is transmitted to a cam gear 32 with which the output shaft 33 is integrally formed through a gear transmission mechanism (not shown). The output shaft 33 protrudes from a hole 7*a* of the case 7 to the outside of the case 7, and is connected to the ice making tray 2. When ice in the ice making tray 2 is removed, the output shaft 33 rotates around the axis L0 in a counterclockwise CCW direction and the ice making tray 2 is inverted, and when the ice making tray 2 is returned to an original position, the output shaft 33 rotates in a clockwise CW direction.

Figure 4:
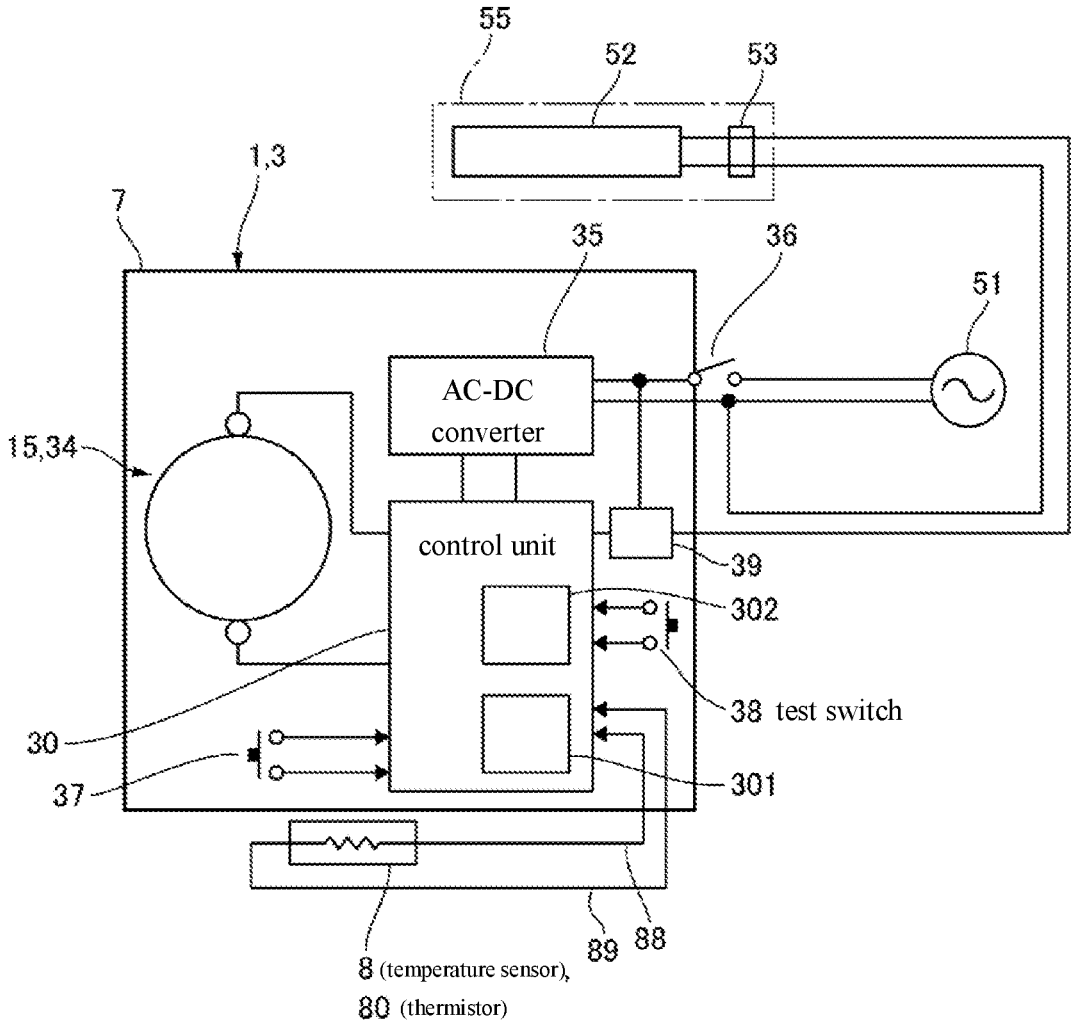
FIG. 4 is an explanatory diagram showing an electrical configuration of a drive unit shown in FIG. 2.

The ice detection lever 6 is disposed at a position adjacent to the ice making tray 2 on the one side Y1 in the second direction Y. An ice detection mechanism causing the ice detection lever 6 to rotate around the axis L1 (second axis) in connection with the cam gear 32 and a switch mechanism to which a signal is input from the temperature sensor 8 described with reference to FIG. 3 through the signal lines 88 and 89, and the like are provided in the drive unit 3. The ice detection mechanism is a mechanism for identifying whether the ice storage container is full or the amount of ice is insufficient. The ice detection lever 6 is connected to a lever connecting part 31*f* of an ice sensing shaft 31 that is driven by a cam surface of the cam gear 32. Accordingly, in an ice detection process, when the ice detection lever 6 is rotated around the axis L1 and lowered into the ice storage container, if the ice detection lever 6 is lowered below a predetermined position, it is detected that ice is insufficient, and if the ice detection lever 6 is not lowered below a predetermined position, it is detected that the ice storage container is full. In the present embodiment, a push switch 37 to be described below with reference to FIG. 4 is disposed in the drive unit 3, and the push switch 37 is turned on or off in connection with rotation of the ice sensing shaft 31. Accordingly, it is possible to determine whether the ice storage container is full of ice by monitoring an output from the push switch 37.

The case 7 includes a first case member 71 made of a resin, a second case member 72 made of a resin, and a third case member 73 made of a resin which are arranged in an overlapping manner in order from the one side X1 to the other side X2 in the first direction X. A first circuit board for power supply including an AC-DC converter 35 to be described below with reference to FIG. 4 and the like and a second circuit board including a control unit 30 to be described below with reference to FIG. 4 are disposed between the first case member 71 and the second case member 72. In addition, the drive mechanism 15 including a motor 34 to be described below with reference to FIG. 4 is disposed between the first case member 71 and the second case member 72.

Electrical Configuration of Drive Unit 3

FIG. 4 is an explanatory diagram showing an electrical configuration of the drive unit 3 shown in FIG. 2 and the like. In FIG. 4, when the ice making device 1 is mounted in a refrigerator main body, an AC voltage is supplied from a power supply 51 on the side of the refrigerator main body to the drive unit 3. Accordingly, in the drive unit 3, a main switch 36 configured to turn an electrical connection between the power supply 51 and the drive unit 3 on or off is provided. In addition, when the ice making device 1 is mounted in the refrigerator main body, in a water supply process, water stored in a water supply tank 52 of a water supply device 55 is supplied to the ice making tray 2 through a water supply valve 53 and a water supply pipe (not shown). In addition, the water supply pipe may be directly connected to a water supply.

The drive unit 3 includes the drive mechanism 15 including the motor 34 (driving source) such as a DC motor, the control unit 30 configured to control the drive mechanism 15 and the like, and the push switch 37 for performing an ice detection process. In addition, the drive unit 3 includes the AC-DC converter 35 configured to convert an AC voltage supplied from the external power supply 51 into a DC voltage. The DC voltage output from the AC-DC converter 35 is supplied to the motor 34 and the temperature sensor 8 through the control unit 30. Accordingly, driving of the motor 34 and an operation of the control unit 30 are performed using the DC voltage supplied from the AC-DC converter 35. Here, the control unit 30 of the drive unit 3 issues a water supply command to the water supply device 55. Thus, a relay 39 for outputting the water supply command output from the control unit 30 to the water supply valve 53 of the water supply device 55 is provided in the drive unit 3.

In the present embodiment, monitoring of a temperature detected by the temperature sensor 8 is performed by a temperature monitoring unit 301 provided in the control unit 30. Thus, the signal lines 88 and 89 that extend from the temperature sensor 8 are connected to the drive unit 3 and are not connected to the refrigerator main body.

Configuration for Inspection of Temperature Sensor 8

In the present embodiment, in order to perform inspection of the temperature sensor 8 (the thermistor 80), a sensor inspection unit 302 is provided in the control unit 30, and the sensor inspection unit 302 includes an inspection circuit, an inspection result determination unit, and the like. The inspection circuit of the sensor inspection unit 302 determines short circuiting and disconnection by comparing a charging time of a capacitor added to a thermistor circuit and a reference voltage. In addition, a test switch 38 that is operated from the outside when an inspection of the temperature sensor 8 is performed is provided in the drive unit 3. The test switch 38 issues an inspection execution command when it is operated from the outside. Here, when an AD converter is provided in the inspection circuit, in addition to determination of whether there is a failure such as a short circuit or disconnection, content of the failure may be determined.

General Operation

Figure 5:
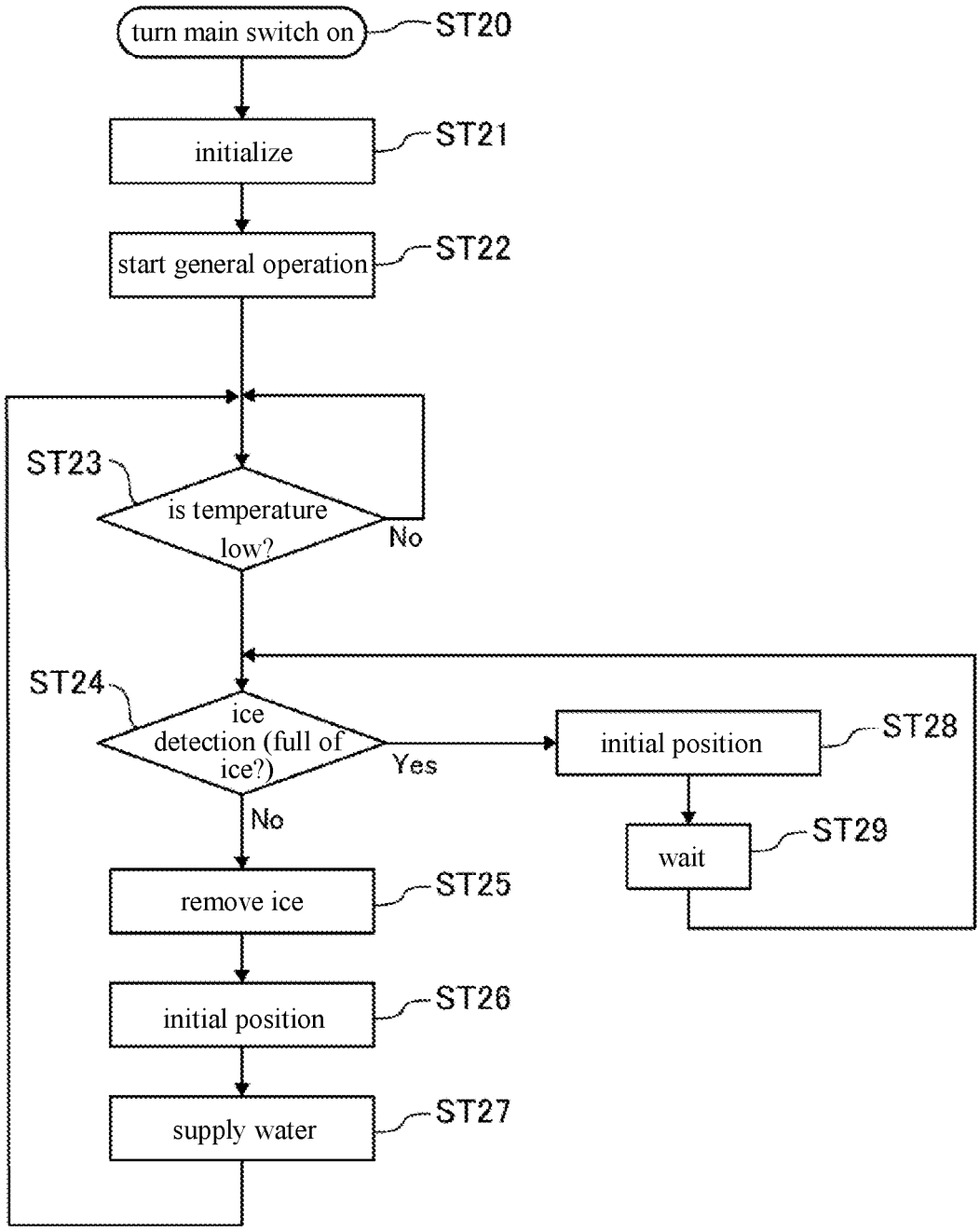
FIG. 5 is a flowchart showing a general operation of an ice making device 1 shown in FIG. 1.

FIG. 5 is a flowchart showing a general operation of the ice making device 1 shown in FIG. 1. The operations shown in FIG. 5 are executed by a program that is stored in advance in a storage unit such as a ROM or a RAM under control of a microcomputer provided in the control unit 30. A general operation (general process) described below is performed when the ice making device 1 is mounted in the refrigerator main body and a general ice making operation is performed. However, the general operation shown in FIG. 5 is performed even if an operation of the ice making device 1 alone is confirmed, and such operation confirmation will be described below.

As shown in FIG. 5, in the ice making device 1 of the present embodiment, when the main switch 36 is turned on in Step ST20, parameters of the drive unit 3 are initialized in Step ST21. Next, in Step ST22, a command to start a general operation is generated and the following operation is performed.

First, in Step ST23, it is confirmed whether ice making is completed by the temperature sensor 8 (the thermistor 80) attached to the ice making tray 2. Such confirmation is determined according to whether a temperature of the ice making tray 2 is equal to or lower than a predetermined temperature by the temperature sensor 8 attached to the ice making tray 2. When a temperature of the ice making tray 2 is not equal to or lower than a predetermined temperature, it is determined that ice making is not completed and waiting is performed until a temperature of the ice making tray 2 is equal to or lower than a predetermined temperature. In the first general operation, since water is not supplied to the ice making tray 2, the temperature sensor 8 checks a temperature of the empty ice making tray 2.

In Step ST23, when it is determined that a temperature of the ice making tray 2 is equal to or lower than a predetermined temperature, it is determined that ice making is completed. In Step ST24 (ice detection process), the ice detection lever 6 is driven and it is determined whether the ice storage container is full of ice. Specifically, when the ice detection lever 6 is lowered to a predetermined position, it is determined that the ice storage container is not full of ice. On the other hand, before the ice detection lever 6 is lowered to a predetermined position, when the ice detection lever 6 comes in contact with ice in the ice storage container, it is determined that the ice storage container is full of ice. In Step ST24, when it is determined that the ice storage container is full of ice, the ice detection lever 6 is returned to an initial position in Step ST28. Then, in Step ST29, waiting is performed for a predetermined time. Then, in Step ST24, again, the ice detection lever 6 is driven and an ice detection process is performed.

On the other hand, in the ice detection process in Step ST24, when it is determined that the ice storage container is not full of ice, in Step ST25 (ice removal process), the ice making tray 2 is caused to perform an inversion operation and a twist operation. Specifically, in FIG. 1 and FIG. 2, when the output shaft 33 of the drive unit 3 is driven to rotate, the ice making tray 2 rotates around the axis L0 counterclockwise CCW. When the ice making tray 2 rotates to a predetermined rotation angle (for example, 120°) of 90° or more from a first horizontally disposed position, the rotation regulating part 29 of the ice making tray 2 comes in contact with the frame 4. In this state, even if the ice making tray 2 tries to further rotate, rotation is prevented and the ice making tray 2 is twisted and deformed. Therefore, when there is ice in the ice making tray 2, ice is removed from the ice making tray 2, and falls into the ice storage container (not shown) provided below the ice making tray 2.

When Step ST25 (ice removal process) is completed, in Step ST26, the drive unit 3 rotates the ice making tray 2 in reverse around the axis L0 clockwise CW so that the recessed parts for water storage 20 face upward, and returns a position of the ice making tray 2 to the initial position. Next, in Step ST27; the control unit 30 outputs a water supply command for performing an operation of supplying water to the ice making tray 2, supply of water to the ice making tray 2 is performed, and the second general operation is then performed. In a general operation after the second general operation, since water supply is performed, ice making is performed in the ice making tray 2. In Step ST23, when it is confirmed that ice making is completed based on a temperature of the ice making tray 2, Step ST24 (ice detection process), Step ST25 (ice removal process), Step ST26 (operation of returning to an initial position), and Step ST27 (water supply process) are sequentially performed.

Inspection Operation

Figure 6:
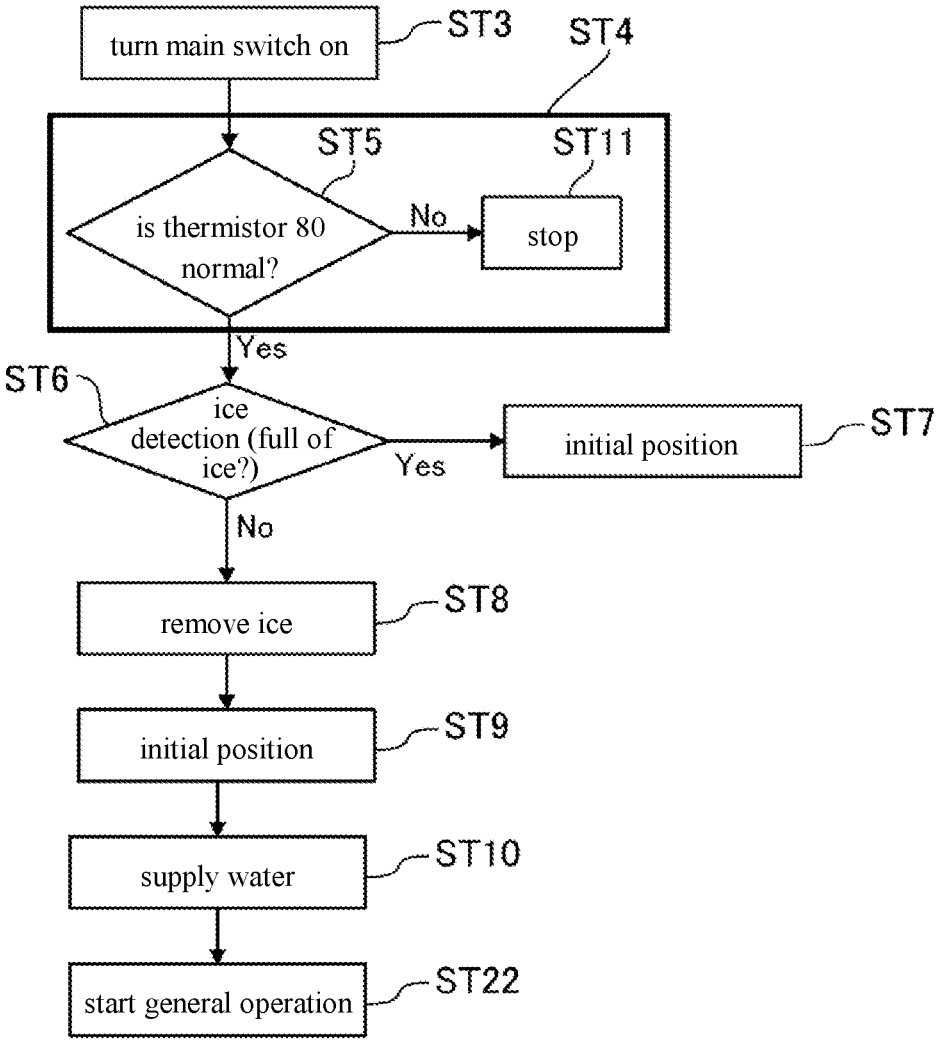
FIG. 6 is a flowchart showing an inspection operation of the ice making device shown in FIG. 1.

FIG. 6 is a flowchart showing an inspection operation of the temperature sensor 8 in the ice making device 1 shown in FIG. 1. The inspection operation (operation confirmation) shown in FIG. 6 is performed when an operation of performing a sensor inspection process on the test switch 38 is performed during execution of the general operation described with reference to FIG. 6. Accordingly, the following inspection operation is performed when the test switch 38 is operated even while the ice making device 1 alone performs operation confirmation of a general operation without mounting the ice making device 1 in the refrigerator main body, in addition to being possible when the ice making device 1 is mounted in the refrigerator main body.

Specifically, in the general operation described with reference to FIG. 5, in Step ST20, the main switch 36 is turned on. In Step ST21, after parameters of the drive unit 3 and the like are initialized, as shown in FIG. 6, when an on operation of performing a sensor inspection process on the test switch 38 is performed (Step ST3), the sensor inspection process is performed in Step ST4. However, when the main switch 36 is operated while the ice removal process in Step ST25 shown in FIG. 5 is performed, in Step ST26, the ice making tray 2 is returned to the initial position. Then, the sensor inspection process is performed in Step ST4 shown in FIG. 6.

In Step ST4 (sensor inspection process), it is determined whether the temperature sensor 8 (the thermistor 80) is normal by checking for disconnection, short circuiting, or the like of the temperature sensor 8 (the thermistor 80) in Step ST5 (determination process).

In Step ST5, when it is determined that the temperature sensor 8 is normal, in Step ST6 (ice detection process), the ice detection lever 6 is driven and an operation of determining whether the ice storage container is full of ice is performed. In Step ST6, when it is determined that the ice storage container is full of ice, the ice detection lever 6 is returned to the initial position in Step ST7. On the other hand, when it is determined that the ice storage container is not full of ice in Step ST6, in Step ST8 (ice removal process), the inversion operation and the twist operation are performed on the ice making tray 2, an operation of discharging ice from the ice making tray 2 into the ice storage container is performed, and then the position of the ice making tray 2 is returned to the initial position in Step ST9. Next, in Step ST10, the control unit 30 outputs a water supply command to perform an operation of supplying water to the ice making tray 2. Then, a command to return to Step ST22 described with reference to FIG. 5 and start a general operation is generated, and a general operation after Step ST23 is performed.

On the other hand, in Step ST5, when it is determined that the temperature sensor 8 has failed, the operation is stopped in Step ST11. Accordingly, for example, in a case when downward movement of the ice detection lever 6 is allowed, if the inversion operation and the twist operation are performed on the ice making tray 2 after operating the test switch 38, a drive mechanism for the ice detection lever 6 and the ice making tray 2 can be determined as normal, and the temperature sensor 8 can also be determined as normal. On the other hand, in a case when downward movement of the ice detection lever 6 is allowed, the temperature sensor 8 can be determined as failed if the inversion operation and the twist operation are not performed on the ice making tray 2 after operating the test switch 38.

Main Effects of Present Embodiment

As described above, in the ice making device 1 of the present embodiment, since signal lines 88 and 89 that extend from the temperature sensor 8 are connected to the drive unit 3, the ice making device 1 is easily mounted in the refrigerator main body because it is not necessary to connect the signal lines 88 and 89 to the refrigerator main body. In this case, the temperature sensor 8 is not connected to the outside (refrigerator main body) of the ice making device 1 through a connector or the like, inspection of the temperature sensor 8 can't be performed through the connector. However, in the present embodiment, using the connection of the signal lines 88 and 89 that extend from the temperature sensor 8 to the drive unit 3, the drive unit 3 itself automatically performs inspection of the temperature sensor 8. Accordingly, even if the signal lines 88 and 89 that extend from the temperature sensor 8 are connected to the drive unit 3, inspection of the temperature sensor 8 can be performed by the ice making device 1 alone.

In addition, in the present embodiment, the control unit 30 performs the sensor inspection process ST4 based on the inspection execution command. Therefore, inspection of the temperature sensor 8 can be performed using a microcomputer used for the control unit 30 or the like. In addition, since the AC-DC converter 35 is provided in the drive unit 3, various processes can be performed in the drive unit 3 even if there is no DC voltage supplied from the outside. In addition, since the drive unit 3 issues a supply water command to the water supply device 55, the water supply process, the ice detection process, operation confirmation of the ice removal process, and the sensor inspection process ST4 can be performed continuously.

Other Embodiments

The above embodiment is an exemplary example of the disclosure, but the disclosure is not limited thereto. Various modifications can be made in a range without departing from the spirit and scope of the disclosure. For example, while the sensor inspection process is performed after the water supply process in the above embodiment, the sensor inspection process may be performed before the water supply process. While disconnection and short circuiting of the temperature sensor 8 (the thermistor 80) are inspected in the above embodiment, an abnormal resistance value may be inspected. While the drive unit 3 causes the ice making tray 2 to perform the inversion operation and the twist operation when the ice removal operation is performed in the above embodiment, the disclosure may be applied to the ice making device 1 in which the drive unit 3 drives a scraping member that scraps off ice from the ice making tray 2. While a DC motor is used as the driving source in the above embodiment, an AC motor, a capacitor motor, or a stepping motor may be used. In addition, a driving source other than a motor such as a solenoid may be used. Also, as a liquid to be iced, in addition to water, beverages such as juice and non-beverages such as a test reagent can be used. In addition, as a unit for detecting whether ice in the ice storage container is ready, in addition to the thermistor 80, a bimetal using a shape memory alloy or the like may be used as the temperature sensor 8.

What is claimed is:

1. An ice making device comprising:

an ice making tray in which recessed parts for water storage are disposed upward;

a temperature sensor that is fixed to a bottom surface of the ice making tray; and a drive unit comprising:

a case, a drive mechanism, which comprises a motor, disposed inside the case, and a sensor inspection circuit disposed inside the case, wherein a signal line that extends from the temperature sensor is connected to the drive unit and the drive unit performs an ice removal process of removing ice from the ice making tray when a temperature detected by the temperature sensor is equal to or lower than a set temperature, wherein the sensor inspection circuit performs a sensor inspection process of automatically inspecting whether the temperature sensor has an abnormality comprising a short circuit and disconnection and determining the content of the abnormality based on an inspection execution command.

2. The ice making device according to claim 1, wherein the drive mechanism is configured to perform an ice removal operation and the drive unit comprises a controller configured to monitor a detection result by the temperature sensor and cause the drive mechanism to perform the ice removal operation when a temperature of the ice making tray is equal to or lower than a set temperature, and wherein the sensor inspection circuit is provided in the controller.

3. The ice making device according to claim 1, wherein the drive unit performs the sensor inspection process during general processes comprising a process of supplying water to the ice making tray and an ice making process in the ice making tray.

4. The ice making device according to claim 1, wherein the drive unit comprises a test switch, and wherein the inspection execution command is issued when an operation for performing the sensor inspection process is performed on the test switch.

5. The ice making device according to claim 1, wherein the drive unit comprises an AC-DC converter configured to convert an AC voltage supplied from an outside into a DC voltage, and wherein the ice removal process and the sensor inspection process are performed using the DC voltage supplied from the AC-DC converter.

6. The ice making device according to claim 1, wherein the drive unit issues a water supply command to a water supply device that supplies water to the ice making tray.

7. The ice making device according to claim 1, wherein the temperature sensor is a thermistor.

8. A method of inspecting an ice making device comprising an ice making tray in which recessed parts for water storage are disposed upward; a temperature sensor that is fixed to a bottom surface of the ice making tray; and a drive unit comprising a case, a drive mechanism, which comprises a motor, disposed inside the case, and a sensor inspection circuit disposed inside the case, wherein a signal line that extends from the temperature sensor is connected to the drive unit and the drive unit performs an ice removal process of removing ice from the ice making tray when a temperature detected by the temperature sensor is equal to or lower than a set temperature, the method comprising:

performing, by the sensor inspection circuit disposed inside the case of the drive unit, a sensor inspection process of automatically inspecting whether the temperature sensor has an abnormality comprising a short circuit and disconnection and determining the content of the abnormality based on an inspection execution command.

9. The method of inspecting an ice making device according to claim 8, wherein the drive mechanism is configured to perform an ice removal operation, and a controller configured to monitor a detection result by the temperature sensor and cause the drive mechanism to perform the ice removal operation when a temperature of the ice making tray is equal to or lower than a set temperature is provided in the drive unit, and wherein the controller performs the sensor inspection process based on the inspection execution command.

10. The method of inspecting an ice making device according to claim 8, wherein the drive unit performs the sensor inspection process during general processes comprising a process of supplying water to the ice making tray and an ice making process in the ice making tray.

11. The method of inspecting an ice making device according to claim 8, wherein a test switch is provided in the drive unit, and wherein the inspection execution command is issued when an operation for performing the sensor inspection process is performed on the test switch.

12. The method of inspecting an ice making device according to claim 8, wherein, in the drive unit, an AC-DC converter configured to convert an AC voltage supplied from an outside into a DC voltage is provided, and wherein the drive unit automatically performs the ice removal process and the sensor inspection process using the DC voltage supplied from the AC-DC converter.

13. The method of inspecting an ice making device according to claim 8, wherein the drive unit issues a water supply command to a water supply device that supplies water to the ice making tray.

14. The method of inspecting an ice making device according to claim 8, wherein the temperature sensor is a thermistor.

* * * * *